United States Patent [19]

Schwiering et al.

[11] Patent Number: 4,770,418

[45] Date of Patent: Sep. 13, 1988

[54] BOWLING PIN SENSOR

[76] Inventors: Werner F. W. Schwiering, 259 Beechy Drive, Richmond Hill, Ontario, Canada, L4C 2X6; Thomas G. England, 420 Prestwick Court, Oshawa, Ontario, Canada, L1J 7G5

[21] Appl. No.: 85,549

[22] Filed: Aug. 17, 1987

Related U.S. Application Data

[63] Continuation-in-part of Ser. No. 836,083, Mar. 4, 1986, abandoned.

[51] Int. Cl.[4] ..... A63D 5/04

[52] U.S. Cl. ..... 273/52; 340/568

[58] Field of Search ..... 273/52; 340/568, 569, 340/570

[56] References Cited

U.S. PATENT DOCUMENTS

| | | | |
|---|---|---|---|
| 2,014,306 | 9/1935 | Barker | 273/52 X |
| 2,346,428 | 4/1944 | Hanley | 273/52 X |
| 3,300,770 | 1/1967 | Brousseau et al. | 273/52 X |
| 3,463,491 | 8/1969 | Shaw | 273/52 |

FOREIGN PATENT DOCUMENTS

| | | | |
|---|---|---|---|
| 366228 | 1/1963 | Switzerland | 273/52 |

*Primary Examiner*—Anton O. Oechsle

[57] ABSTRACT

A sensor for use in a lane of a bowling center to detect the relative position of a bowling pin, comprising a light responsive electrical device with a superimposed light conductive protector, the light conductive protective means having a refractive index and a length/diameter ratio whereby light entering therein will reach the light responsive electrical means only below a predetermined angle of incidence.

10 Claims, 2 Drawing Sheets

BOWLING PIN SENSOR

FIELD OF THE INVENTION

This invention relates to the setting of pins in a bowling centreand more particularly to a sensor for automatically sensing the position of the pins in a bowling lane.

BACKGROUND OF THE INVENTION

A modern bowling centre has automatic pin setting apparatus for re-positioning the pins in a bowling lane after each frame is played. Such apparatus usually includes either ultrasonic or light beam scanning equipment to confirm the position of the pins after they have been re-set. Off spot location of a pin is a problem because a pin may wobble after being set up by the automatic setting device. However, the ultrasonic or light beam scanning equipment is not sensitive enough to detect that a pin is only slightly off its proper spot location and the only way to detect the displacement is to recycle the setting device. In any event the known equipment is expensive and requires skilled installation and maintenance. Furthermore the known equipment requires a mainframe computer for its operation, which makes it economical only for large centres having twelve or more lanes.

Prior patents are known which disclose devices for detecting the position of a bowling pin over a given spot. An example of such a device is seen in U.S. Pat. No. 2,014,306 issued Sept. 10, 1935 to G. D. Barker. However, the Barker device provides its own light source with a reflector on the bottom of the pin which contravenes regulations governing the bowling sport. Another detector carrying its own light source is disclosed in U.S. Pat. No. 2,346,428 to N. Hanley. A dector using a photocell is shown in Swiss Patent No. 366,228 to Rossetti dated Dec. 15, 1962. Both the Hanley device and the Rossetti device suffer from the disadvantage that any irregularity in the bottom of the pin overlying the detector will allow light to enter through the transparent cover of the dector which may activate the photocell, thus causing the device to be inaccurate.

It is an object of the present invention to provide a pin sensor, for use in a bowling centre lane, which has an improved ability to detect the off spot location of a bowling pin.

SUMMARY OF THE INVENTION

Essentially the invention consists of a sensor for use in a lane of a bowling centre to detect the relative position of a bowling pin, comprising light responsive electrical means having leads extending therefrom; light conductive protective means superimposed on the electrical means, and casing means carrying the electrical means and the light protective means for embedding in the lane whereby the light protective means is exposed at the upper surface of the lane and the leads of the electrical means are accessible through the underside of the lane, the light conductive protective means having a refractive index and a length/diameter ratio whereby light entering therein will reach the light responsive electrical means only below a predetermined angle of incidence.

An array of such sensors positioned in a predetermined pattern about the spot location of a pin further improves the information available concerning the disposition of the pins.

BRIEF DESCRIPTION OF THE DRAWINGS

An example embodiment of the invention is shown in the accompanying drawings in which.

BRIEF DESCRIPTION OF PREFERRED EMBODIMENT

Figure 1:
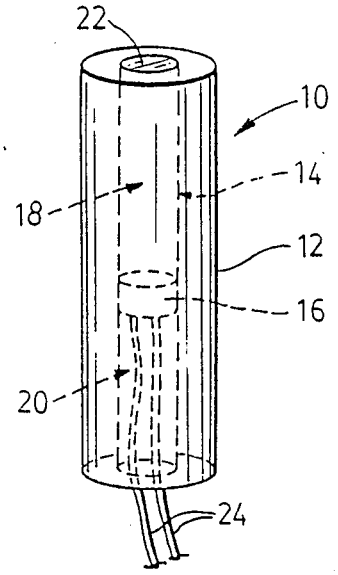
FIG. 1 is a perspective view of a sensor.

The example embodiment shown in the drawings consists of a sensor 10 having a tubular casing 12 with an axial bore 14. Light responsive electrical means such as a photoelectric cell 16 is located within bore 14, dividing the bore into an upper section 18 and a lower section 20. Upper bore section 18 is filled by a protective plug 22 of light conductive material. Leads 24 of cell 16 pass out from casing 12 through lower bore section 20 which is preferably filled with a filler compound 25 such as epoxy resin.

The material of plug 22 must be capable of transmitting light to photoelectric cell 16 and a sythetic translucent material which is shatterproof is preferred, for example a bullet proof plastic sold by General Electric Corporation of Schenectady, N.Y., U.S.A. under the trade mark LEXAN. The material casing 12 is preferably flexible and capable of withstanding impact, for example a solid mylon material sold by E. I. duPont de Nemours and Company of Willimgton, Del., U.S.A. under the trade mark NYLOTRON. Photocell 16 may be a cadmiun sulphide photocell.

Figure 3:
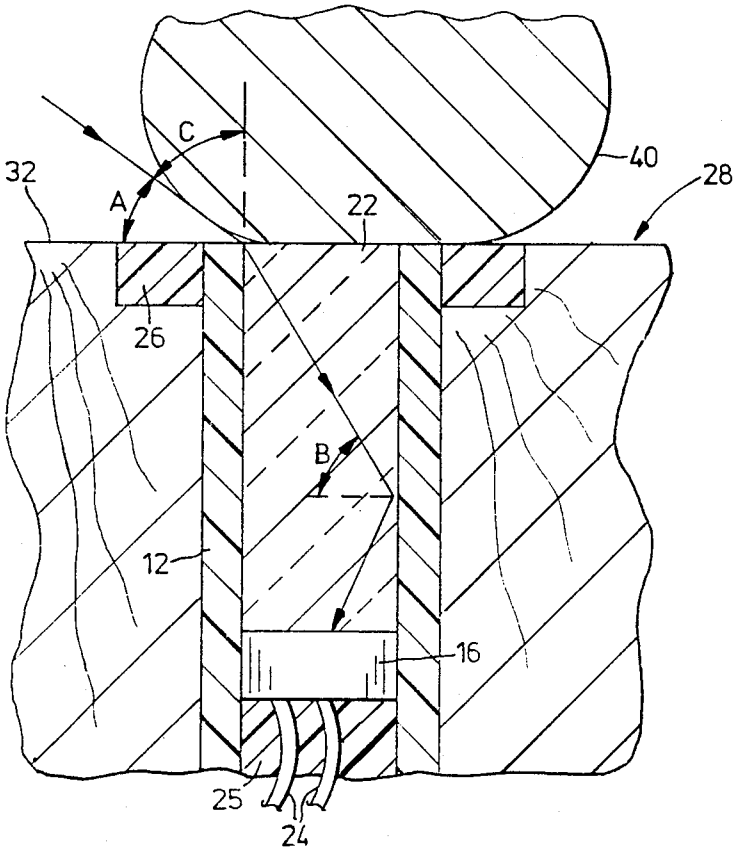
FIG. 3 is a fragmentary view similar to FIG. 2 showing a bowling pin in situ.

In the operation of the example embodiment a plurality of sensors 10 are positioned on and adjacent a spot location, marked by a circular wear plate 26, of each pin in a lane 28 as seen in FIG. 3 of the drawings. Each sensor 10 is embedded in lane 26 by drilling a hole 30 downward from upper surface 32 of the lane through to the underside (not shown) and inserting the sensor into the hole to have the upper end of the sensor coplanar with the drawing. When sensor 10 has been positioned in this manner leads 24 project from the underside 34 of the lane for connection to a computer through a buffer amplifier. Preferably hole 30 has a diameter no larger than the diameter of sensor 10 and the sensor, with glue, is forced into the hole by hammering in the manner of a nail or by other suitable means.

As seen in FIG. 3, a pin 40 which is slightly off centre will allow some light to leak into sensor 10 but the pin may still be considered to be properly located over the sensor. However, a greater off-centre positioning would not be considered acceptable. Sensor 10 allows light below a predetermined angle A to pass into plug 22 without reaching photocell 16. The degree of angle A depends upon the refractive index of the material of plug 22 and also the ratio between the length and the diameter of the plug. Assuming a plug 22 to have a refractive index of 1.36 and a diameter of 0.375", the critical angle B for total internal reflection would 47.3°. Therefore the angle of incidence C would be 67.2°, angle A would be 22.8°, and length L would be a minimum of 0.41". Any light falling in sensor 10 at the angle of less than 22.8° from the surface of the bowling lane would be effectively filtered out and not reach photocell 16.

Figure 4:
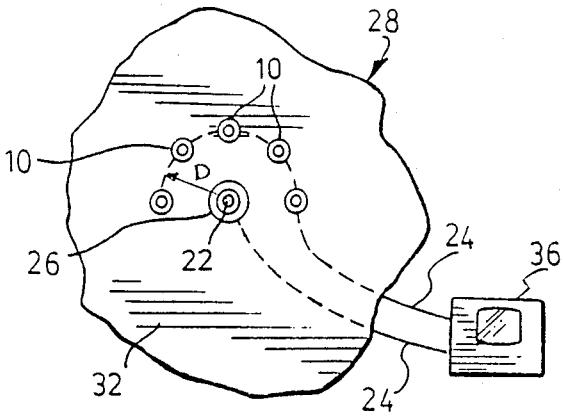
FIG. 4 is a fragmentary plan view of a bowling lane surface showing a plurality of sensors located in a pattern at a pin spot.
Figure 5:
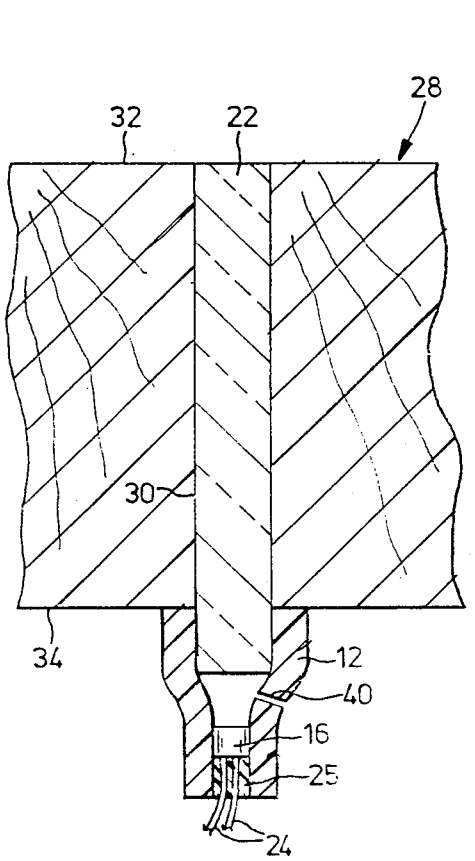
FIG. 5 is a longitudinal cross-sectional view of an alternate embodiment of a sensor.

It may be preferable to place a plurality of sensors 10 in an array about spot location 26 of each pin to be most effective as seen for example in FIG. 4 of the drawings. Sensor 10 positioned on spot location 26 is connected individually to a computer 36 and the remaining sensors are connected in series to the terminal. Because of the simplicity of interpretation of the sensors each lane is supplied with a separate small computer for readout, which is advantageous for centres with few lanes. The array of FIG. 4 enables the disposition of each bowling pin to be ascertained, i.e whether it is on or off spot and also whether it is upright or not. By arranging the array of sensors 10 with an offset D not greater than the largest radius of the bowling pin, any offset of the pin will cover at least one of the sensors and if the pin has been knocked over, none of sensors 10*a* will be covered, allowing the readout of the computer to indicate either of these two conditions. Of course sensors 10 of the array would have to be of sufficiently large diameter to prevent a bowling pin lying on its side from blocking all light above the critical angle of incidence.

It will be appreciated that casing 12 and plug 22 could be integral, i.e. of shatterproof translucent material with photoelectric cell 16 embedded in it. Light responsive electrical means other than photoelectric cell 16 could be used in the invention, such as a light emitting diode (LED).

Figure 2:
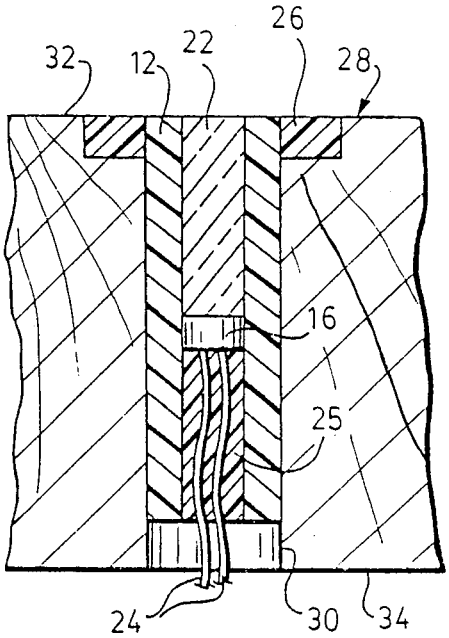
FIG. 2 is a longitudinal cross-sectional view of the sensor of FIG. 1 in situ.

In the alternate embodiment shown in FIG. 4 plug 22 is force fitted into bore 30 having the diameter of the plug with the lower end of the plug protuding below underside 34 of lane 28. Tubular casing 12 is force fitted over the protuding end of plug 22, the casing having an vent 42 to prevent entrapment of air. This arrangement allows plug 22 to be hammered into lane 28 without the risk of damaging photocell 16. Also bore 30 is of less diameter than in the embodiment of FIGS. 1 to 3 which weakens lane 28 less. Preferably casing 12 in this embodiment is elastic, for example rubber, for ease in fitting over the end of plug 22.

It will be seen that the device of the invention is simple both in construction ad in installation while being highly resistant todamage and disorientation both because of its construction and because of its protected location. Also, the surface of the lane can be sanded without affecting the operability of the embedded sensors which are merely reduced in length in their upper portions.

The device of the invention will operate with ordinary light and pit light illumination is adequate for the purpose.

We claim:

1. A sensor for embedding in a lane of bowling alley to detect the relative position of a bowling pin, comprising:

casing means; light conductive protective means receivable in the casing at one end of the casing; and light responsive electrical means fixed in the casing means adjacent the protective means and having leads extending out from the casing means at the other end thereof;

the protective means having a refractive index and a length/diameter ratio whereby light entering the protective means will reach the electrical means only below a predetermined angle of incidence.

2. A sensor as claimed in claim 1 in which the protective means is wholly received in the casing.

3. A sensor as claimed in claim 1 in which one end of the protective means is received in the casing.

4. A sensor as claimed in claim 1 in which the material of the light conductive protective means in shatterproof.

5. A sensor as claimed in claim 1 in which the material of the casing is impact resistant.

6. A sensor as claimed in claim 5 in which the casing means carries a filler extending into the casing from the other end thereof, the leads extending through the filler.

7. A sensor as claimed in claim 1 in which the light responsive means is a photoelectric detector.

8. A sensor as claimed in claim 1 in which the casing means and the light conductive protective means are fabricated integrally of shatterproof light conductive material.

9. A sensor for detecting the relative position of a pin in the lane of a bowling alley, comprising:

light responsive electrical means having electrical conductive means extending therefrom; and casing means embedding the electrical conductive means in a predetermined position in the lane in the area of the spot location of the pin, the casing means carrying light conductive protective means positioned over the electrical conductive means and exposed at the upper surface of the lane;

the light conductive protective means having a refractive index and a length/diameter ratio whereby light entering therein will reach the light responsive electrical means only below a predetermined angle of incidence.

10. A system for sensing the relative positions of the pins in a lane of a bowling alley, comprising an array of sensors positioned in a predetermined pattern with respect to the spot location of each pin, each sensor comprising light responsive electrical means having leads extending therefrom and casing means embedding the electrical means in the lane, the casing means carrying light conductive protective means positioned over the electrical means and exposed at the upper surface of the lane, the leads of the sensors being connectable through the underside of the lane to readout means;

the light conductive protective means having a refractive index and a length/diameter ratio whereby light entering therein will reach the light responsive electrical means only below a predetermined angle of incidence.

* * * * *